US005667248A

United States Patent [19]

Mayer

[11] Patent Number: 5,667,248

[45] Date of Patent: Sep. 16, 1997

[54] GREETING CARD WITH DETACHABLE MESSAGE COVERS

[76] Inventor: Lisa Mayer, 37 Harvard Rd., Scarsdale, N.Y. 10583

[21] Appl. No.: 517,912

[22] Filed: Aug. 22, 1995

[51] Int. Cl.[6] ..... B42D 15/00

[52] U.S. Cl. ..... 283/67; 283/901; 283/117

[58] Field of Search ..... 283/67, 70, 117, 283/62, 94, 98; 40/124.1; 229/92.8

[56] References Cited

U.S. PATENT DOCUMENTS

| | | | |
|---|---|---|---|
| 4,272,327 | 6/1981 | Logan | 283/62 X |
| 5,165,726 | 11/1992 | Talbott | 283/62 X |
| 5,232,248 | 8/1993 | Talbott | 283/62 X |
| 5,282,649 | 2/1994 | Williams et al. | 283/62 X |

OTHER PUBLICATIONS

Jan Pienkowski, ROBOT, at p. 3, published in 1981 by Dell. ISBN 0–440–40539–4.

*Primary Examiner*—Willmon Fridie, Jr.
*Attorney, Agent, or Firm*—Robert S. Mayer

[57] ABSTRACT

Greeting cards in which portions of messages are obscured by one or more detachable covers, so that the messages are revealed when the covers are moved. In a preferred embodiment, the detachable covers are POST-IT brand notes.

27 Claims, 2 Drawing Sheets

GREETING CARD WITH DETACHABLE MESSAGE COVERS

BACKGROUND OF THE INVENTION

1. Field of the Invention

The present invention relates to greeting cards.

2. Description of the Prior Art

Conventional greeting cards are ordinarily printed on a folded piece of heavy paper. They often use a two-part message: The first part of the message is imprinted on the outside of the card and is visible before the card is opened. The second part of the message is imprinted on the inside of the card and can not be read until after the card is opened.

The first part of the message is used to prime the reader for the upcoming second part. After the reader has seen the first part of the message, the card is opened and the second part of the message is read. This arrangement is commonly used to convey a joke, using the second part of the message to deliver the punch line.

While conventional greeting cards work well to convey two-part messages, alternate methods of conveying these messages provide variety in a field where variety is a desirable attribute.

SUMMARY OF THE INVENTION

The present invention provides a greeting card that can deliver a multi-part message on a single page using a detachable covering.

The greeting card is made of a substrate, a detachable covering affixed to the substrate, information printed on the substrate which is concealed beneath the covering, and instructions that prompt the reader to move the covering. When the covering is moved away from its initial position, the end of the message is revealed.

DETAILED DESCRIPTION OF THE PREFERRED EMBODIMENTS

Figure 1A:
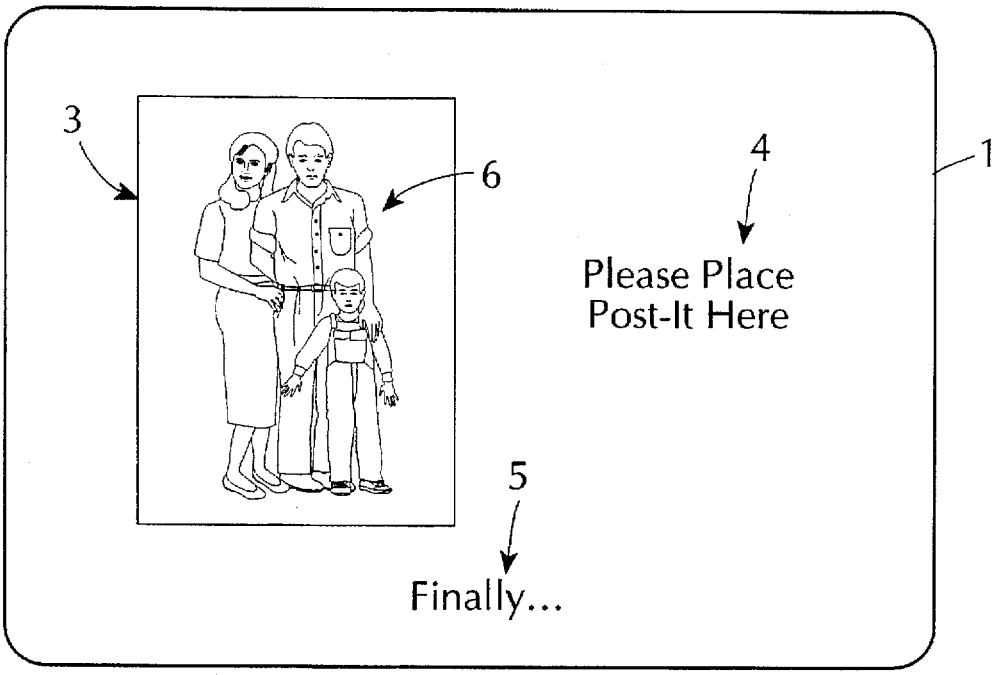
FIG. 1*a* shows the initial state of a first embodiment of the greeting card of this invention.
Figure 1B:
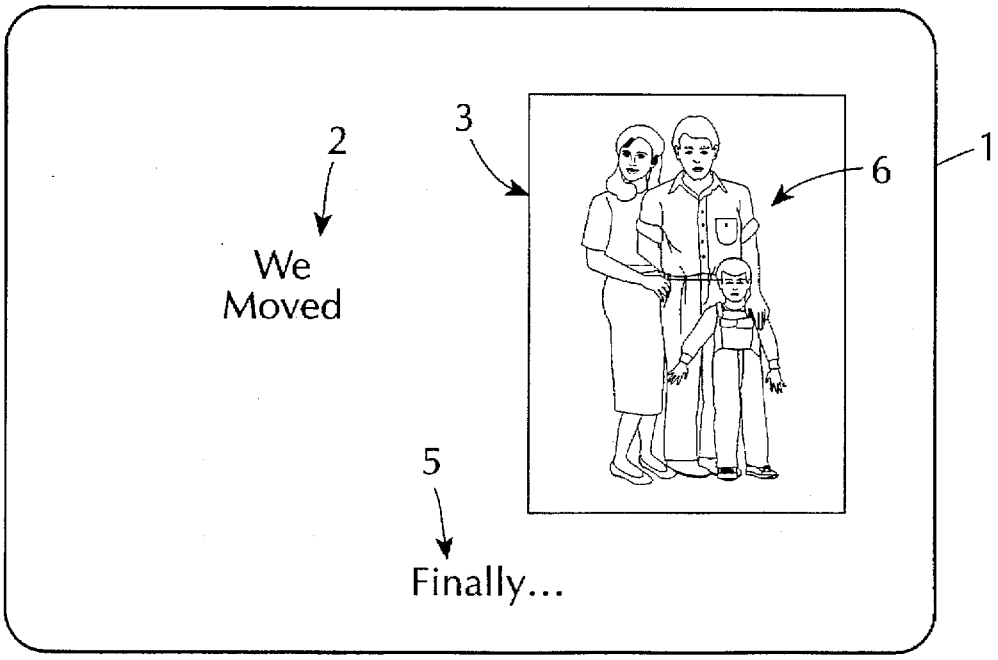
FIG. 1*b* shows the final state of the first embodiment of the card.

FIGS. 1*a* and 1*b* illustrate a first embodiment of the greeting card of this invention. This embodiment starts with a substrate 1 made out of a solid material such as plastic, glass, metal, wood, cloth, stone, cardboard, paper, etc. Heavy paper is a preferred material. Information 2, which can include text or graphics, is printed on the substrate. The printing can be accomplished in numerous ways such as offset printing, laser printing, photographic printing, etc. Equivalents to printing, such as handwriting, stamping, painting, engraving, pasting, embossing, etc. can also be used. When the card is assembled, a detachable covering 3 is affixed to the substrate so as to conceal the printed information, or a portion thereof. This detachable covering is affixed to the substrate with any of a variety of attachment mechanisms including, but not limited to, velcro, snaps, zippers, etc. A preferred attachment mechanism is a reusable, removable adhesive. The detachable covering can be made of a solid material that can be the same or different from the substrate material. Paper coverings are preferred. POST-IT brand notes make excellent coverings because an appropriate adhesive is pre-applied. When the term "post-it" appears herein in lower case letters, that term is being used in its generic sense, which includes POST-IT brand notes and equivalent products. POST-IT is a trademark of 3m.

FIG. 1*a* depicts the card in its "initial state". Ordinarily, the card will be in the initial state the first time it is picked up by the reader.

Instructions 4 are also printed on the greeting card and are visible when the card is in its initial state. The instructions prompt the reader to move the covering 3 away from its original position. For example, instructions printed on the substrate, such as "remove POST-IT" or "place POST-IT here", would be suitable when a POST-IT brand note is used as the covering. Or else the word "lift" could be printed on the covering itself. Many other messages would also work well. Pictorial or graphic instructions, like a drawing of a turned up corner on the covering, can also be used.

An additional message 6 may be printed on the covering. The additional message can include textual or graphic information. This additional message is also referred to as second information. The card can also include an introductory message 5. This introductory message is visible in the card's initial state. The additional message or the introductory message can be used as the first part of the two-part message described above.

After viewing the card in its initial state, the reader follows the instructions and moves the covering 3 away from its original position. This uncovers the area under the covering 3 and reveals the printed information 2. FIG. 1*b* shows the card in its "final state", after the covering has been moved. In this state, the information becomes visible. The information is then read by the user, thereby delivering the second part of the two-part message.

Figure 2A:
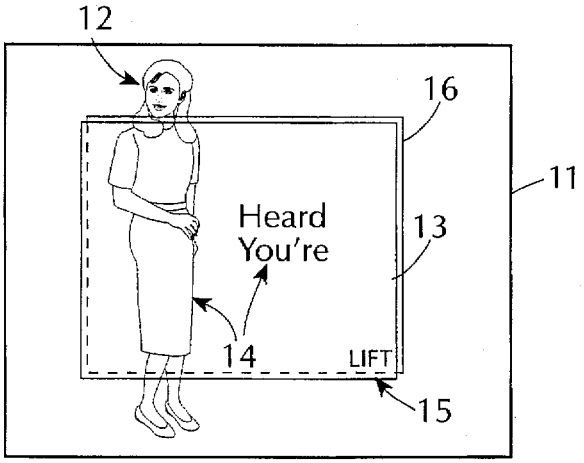
FIG. 2*a* shows the initial state of a second embodiment of the greeting card of this invention.
Figure 2B:
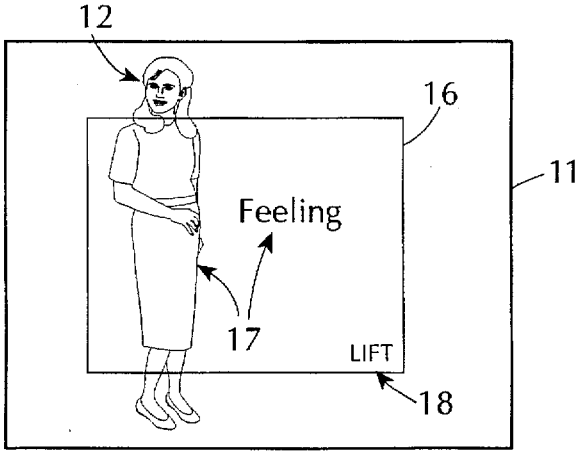
FIG. 2*b* shows an intermediate state of the second embodiment of the card.
Figure 2C:
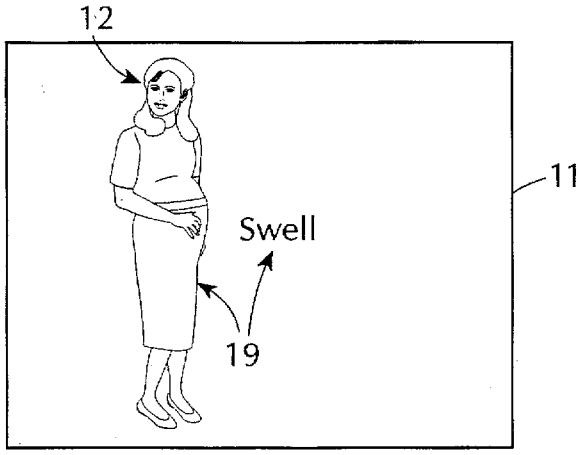
FIG. 2*c* shows the final state of the second embodiment of the card.

FIGS. 2*a*, 2*b*, and 2*c* illustrate a second embodiment. This embodiment also starts with a substrate 11. Lower information 19 is printed on the substrate. When the card is assembled, a detachable lower covering 16 is affixed to the substrate so that the lower information 19 is covered. An upper covering 13 is affixed so as to cover part or all of the lower covering 16 and to cover the upper information 17. The substrate, the upper covering, the lower covering, the printing, and the affixing are each similar to those of the first embodiment described above.

FIG. 2*a* depicts the greeting card in its "initial state". Ordinarily, the card will be in the initial state the first time it is picked up by the reader.

In the initial state, introductory information 12 that is printed on the substrate is visible. An additional message 14, printed on the upper covering, is also visible. Instructions 15 that prompt the reader to remove the upper covering 13 are also visible. The word "lift" is a suitable instruction. Other instructions are also suitable, as described for the first embodiment.

After viewing the card in its initial state, the reader follows the instructions and removes the upper covering 13. This uncovers the area under the upper covering 13 and reveals the upper information 17. FIG. 2*b* shows the card in an "intermediate state", after the upper covering has been removed. Instructions 18 prompting the reader to remove the lower covering are visible in the intermediate state.

After the reader has read the upper information 17, the reader follows the instructions 18 and removes the lower covering 16. This brings the card into its final state, as shown in FIG. 2*c*. In the final state, the reader can see the lower information 19 that is printed on the substrate 11. This mechanism provides the reader with a three-part message.

The greeting card can be packaged in a sealed package such as an envelope or shrink-wrap plastic. The outside of the package can depict the various states of the card that is contained inside. The package can also be transparent.

The invention is not limited to the embodiments disclosed above. Other possible embodiments include using three or more coverings in order to provide a multi-part message. Or else a single covering could be sequentially moved to multiple positions on a single substrate. Numerous other embodiments, modifications, and equivalents that fall within the spirit and scope of the claims can be readily envisioned.

I claim:

1. A greeting card, comprising:

a substrate;

a detachable covering affixed to said substrate so as to cover a first area of said substrate;

information printed on the first area of said substrate such that said information is concealed by said covering; and instructions for prompting a reader to detach said covering from the first area of said substrate, wherein said covering, when detached, remains substantially intact.

2. The greeting card according to claim 1, wherein said covering is affixed to said substrate with a removable adhesive.

3. The greeting card according to claim 2, wherein the removable adhesive remains on said covering and retains its tack after said covering is removed from said substrate.

4. The greeting card according to claim 3, further comprising an additional message printed on said covering.

5. The greeting card according to claim 4, wherein said instructions prompt the reader to move said covering to a position where said covering will cover a second area of said substrate.

6. The greeting card according to claim 5, wherein said instructions are printed in the second area.

7. The greeting card according to claim 5, wherein said instructions are printed on said substrate.

8. The greeting card according to claim 3, wherein said covering is paper.

9. A greeting card, comprising:

a substrate;

a detachable lower covering affixed to said substrate;

lower information printed on said substrate and concealed beneath said lower covering;

a detachable upper covering affixed to cover part or all of said lower covering;

upper information printed beneath said upper covering and concealed by said upper covering;

instructions for prompting a reader to remove said upper covering; and instructions for prompting a reader to remove said lower covering after said upper covering has been removed.

10. The greeting card according to claim 9, wherein said upper covering and said lower covering are affixed with a removable adhesive.

11. The greeting card according to claim 10, wherein the removable adhesive remains on said upper covering and said lower covering and retains its tack after said upper covering and said lower covering are removed.

12. The greeting card according to claim 11, further comprising an additional message printed on said upper covering.

13. The greeting card according to claim 11, wherein said upper covering and said lower covering are paper.

14. The greeting card according to claim 11, further comprising introductory information which is visible before said upper covering is removed.

15. A method of communicating with a reader, comprising the steps of:

printing information on a substrate;

affixing a detachable covering to a first position on the substrate so as to conceal the information;

printing instructions that prompt the reader to remove the covering from the first position and to affix the covering to a second position on the substrate; and allowing the reader to read the information after the covering has been removed.

16. The method according to claim 15, wherein the covering is affixed with a removable adhesive that remains on the covering and retains its tack after the covering is removed from the substrate.

17. The method according to claim 16, further comprising the step of printing a message on the covering.

18. The method according to claim 15, wherein the instructions are concealed by the covering when the covering is affixed to the second position.

19. The method according to claim 17, wherein the covering is paper.

20. An apparatus for communicating with a reader, comprising:

a substrate;

a detachable covering affixed to said substrate so as to cover a first area of said substrate;

first information printed on the first area of said substrate such that said first information is concealed by said covering; and instructions, printed on a second area of said substrate separate from the first area, for prompting a reader to attach said covering to a third area of said substrate separate from the first area, wherein said covering is affixable to said substrate after being detached, and wherein said apparatus is a greeting card.

21. The apparatus according to claim 20, wherein said covering, when attached to the third area, conceals the instructions.

22. The apparatus according to claim 21, wherein said covering comprises a sticker.

23. The apparatus according to claim 21, wherein said covering comprises a post-it.

24. The apparatus according to claim 21, further comprising second information printed on said covering.

25. The apparatus according to claim 21, wherein said first information conveys a final portion of a message.

26. The apparatus according to claim 25, wherein said final portion is a phrase.

27. The apparatus according to claim 25, wherein said final portion is a sentence.

* * * * *